United States Patent [19]

Grunstad

[11] 4,275,519

[45] Jun. 30, 1981

[54] WALL MOUNTED TELEPHONE INDEX

[75] Inventor: Jerome A. Grunstad, West St. Paul, Minn.

[73] Assignee: Ketcham & McDougall, Inc., Roseland, N.J.

[21] Appl. No.: 75,940

[22] Filed: Sep. 17, 1979

[51] Int. Cl.[3] ..... B42F 17/34

[52] U.S. Cl. ..... 40/378; 40/379; 40/389

[58] Field of Search ..... 40/373, 377, 378, 379, 40/390, 389, 509, 532

[56] References Cited

U.S. PATENT DOCUMENTS

| | | | |
|---|---|---|---|
| 2,184,853 | 12/1939 | Smythe | 40/388 X |
| 2,341,983 | 2/1944 | Faas | 40/389 |
| 2,524,704 | 10/1950 | Henderson | 40/389 |
| 2,593,475 | 4/1952 | Neilsen | 40/389 |
| 3,061,963 | 11/1962 | Buckley, Jr. | 40/389 |
| 3,192,658 | 6/1965 | McGurn | 40/389 |
| 3,220,126 | 11/1965 | Gabrielson | 40/532 X |
| 3,816,949 | 6/1974 | Laughlin | 40/389 |

*Primary Examiner*—John F. Pitrelli
*Assistant Examiner*—G. Lee Skillington
*Attorney, Agent, or Firm*—Edwin E. Greigg

[57] ABSTRACT

A wall mounted telephone index including a housing arranged to be mounted in a substantially vertical position on a wall, the housing having a front opening for access to the interior in which a stack of pivotally mounted index cards are disposed with a pivotally mounted door on the housing for closing the front opening and maintaining the cards in a storage position. A slide selector is mounted on the housing for movement into a selected position for retaining engagement with a selected card so that when the door is pivoted downward manually, the index cards overlying the selected card pivot downwardly to display the selected index card.

10 Claims, 10 Drawing Figures

FIG. 1
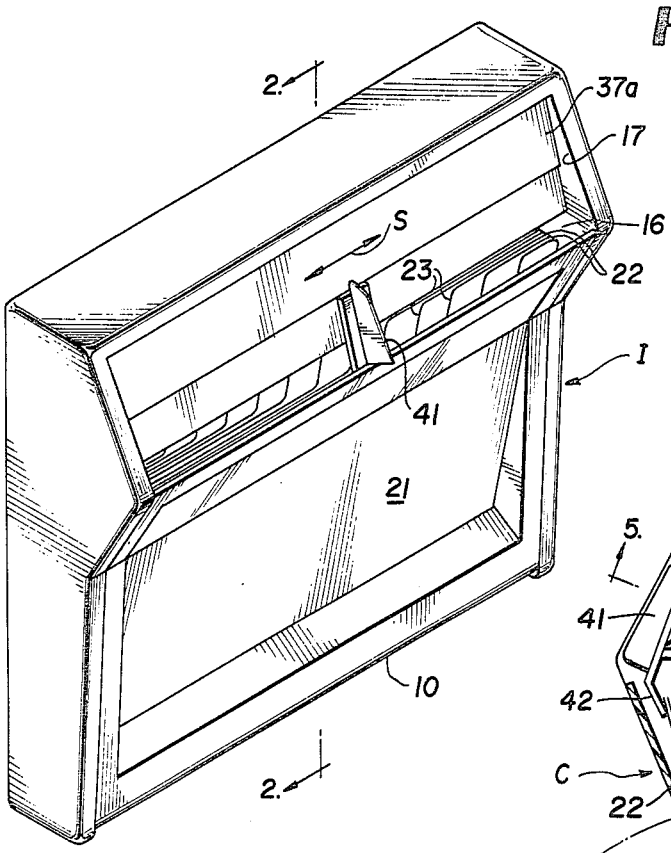
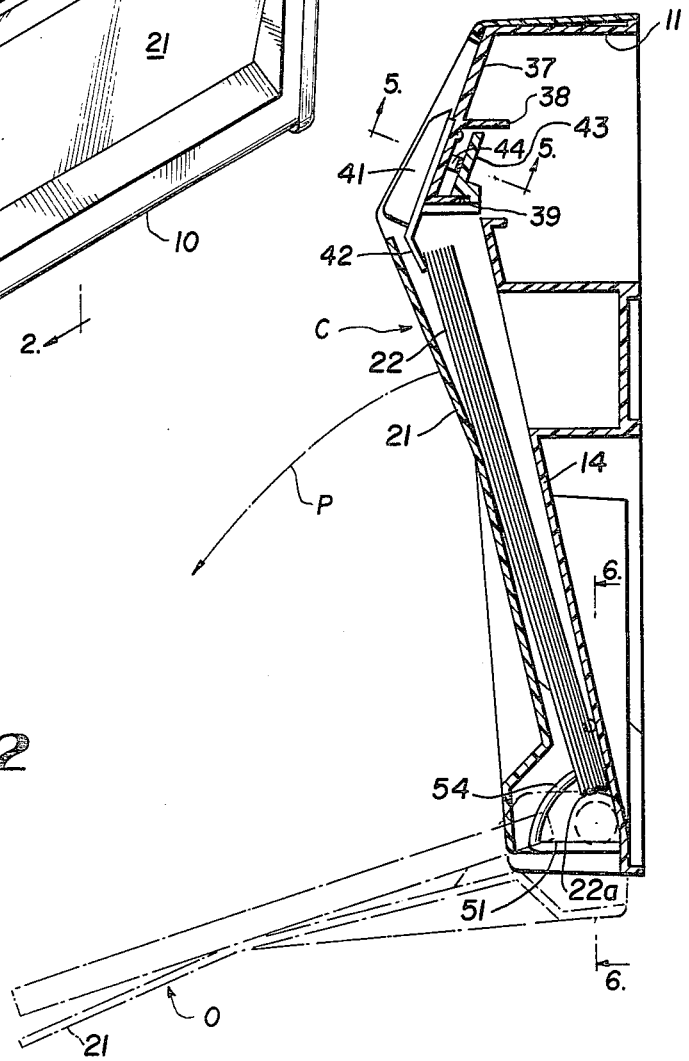
FIG. 2

FIG. 3
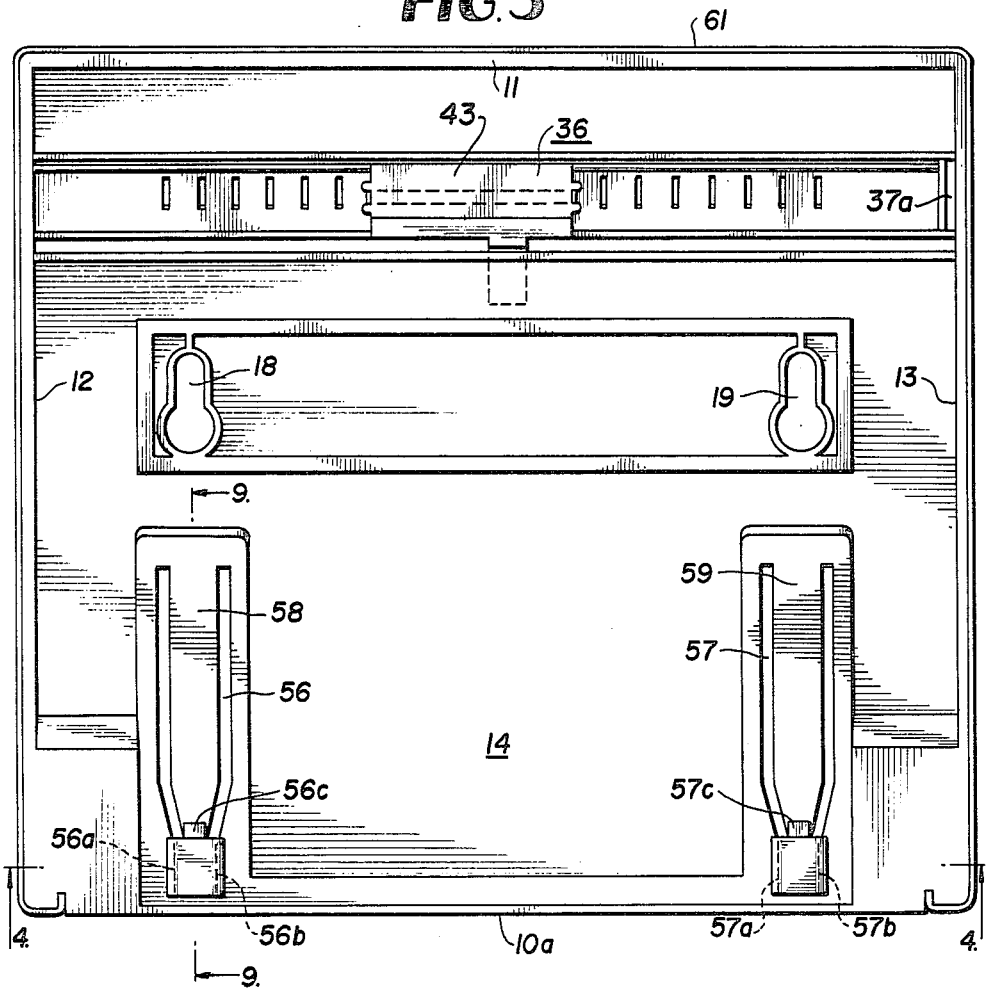
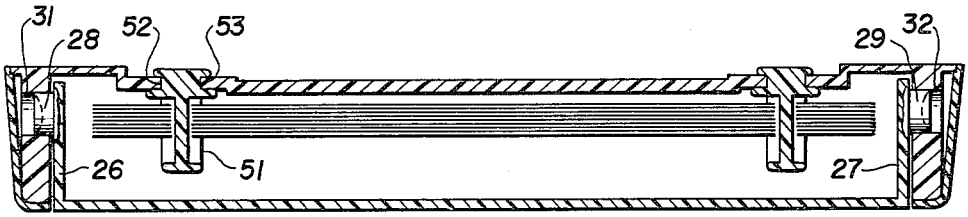
FIG. 4

FIG. 5
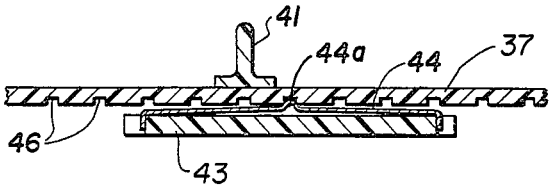
FIG. 6
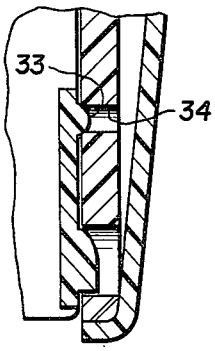
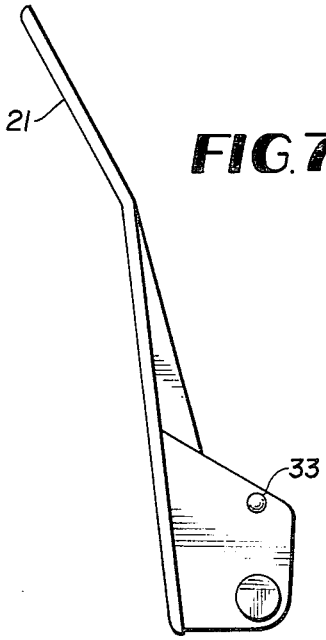
FIG. 7
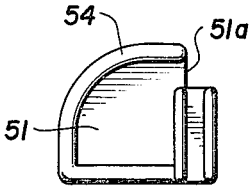
FIG. 8
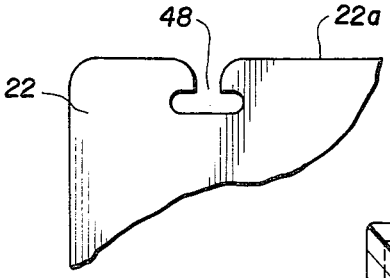
FIG. 10
FIG. 9
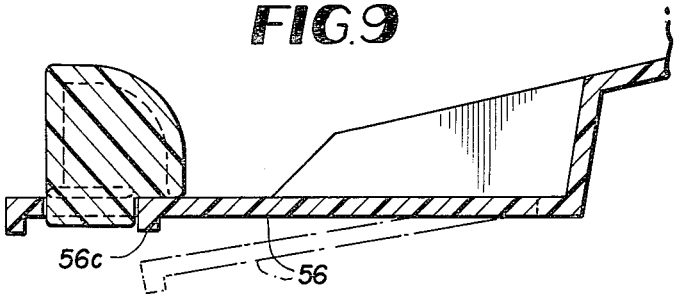

WALL MOUNTED TELEPHONE INDEX

BACKGROUND OF THE INVENTION

One of the most widespread devices for use in quickly locating telephone numbers and addresses is the common telephone index which in its most typical form is arranged to be placed on a desk, a table or the like for ready access by the user. Such telephone indexes are provided with a plurality of index cards arranged in a stack within a housing, each of the cards being provided with a suitable alphabetical tab for locating the card on which is listed the number and address of a party to be contacted, which identity corresponds to the appropriate tab. Such present day telephone indexes are provided with a slide selector by means of which a particular index card is selected and suitable release means are provided on the housing by means of which a spring loaded cover plate is lifted, together with the index cards overlying the selected card, to display the selected card and its information contained thereon.

The positioning of such present day telephone indexes on a desk or the like poses certain disadvantages such as adding to the clutter common to the typical office desk and frequently becomes buried under the usual array of material which accumulates on a desk, thereby making it difficult to locate the index, particularly when time is of the essence. Furthermore, such present day indexes are not secured to the desk top in a permanent location so that it is not uncommon for damage to the index to occur when it is inadvertently pushed off the desk top. In addition, the use of such a desk top telephone index limits further the availability of space on a desk wherein space is already at a premium.

Another undesirable feature of such telephone indexes is their rather complicated construction due in part to the need for constructing the index of relatively heavy material for stability, but primarily because such telephone indexes require components such as springs, release mechanisms and the like for operation of the index such as releasing and lifting the door automatically when an index card selection is to be made. All of these features add considerably to the manufacturing cost and therefore the retail cost of such indexes.

OBJECTS AND SUMMARY OF THE INVENTION

Accordingly, the primary object of this invention is to provide a new and novel telephone index which is arranged to be mounted on a wall surface.

Another object of this invention is to provide a new and novel telephone index for mounting on a wall which relieves the user of the problem of finding space on a desk top or the like for the index, and in which the index is not subject to damage from being inadvertently pushed off an elevated surface.

Still another object of this invention is to provide a new and novel telephone index which is arranged to be mounted on a wall surface and therefore enables the use of the force of gravity for exposing a selected index card.

A still further object of this invention is to provide a new and novel telephone index for mounting on a wall surface which is simple and inexpensive in construction, which eliminates many component parts common to present day telephone indexes, and which may be manufactured in a one piece construction of inexpensive material such as plastic or the like.

The objects of the invention and other related objects are accomplished by providing a housing having a rear wall, a top wall and a pair of side walls defining an interior in which are detachably mounted a stack of index cards provided with alphabetical tabs in the conventional manner. The housing rear wall is provided with keyhole slots for the mounting of the housing on the vertical surface of the wall and the front of the housing is open to permit the stack of index cards to be positioned within the housing interior. A door is provided on the housing for closing the front opening and retaining the index cards in the stored position, the door being pivotally mounted in a detachable manner on the housing. The housing also includes a slidable index card selector transversely slidable on the housing for engagement with the tab on a selected one of the index cards so that when the index card is selected, the door may be manually pivoted downwardly into a dropped position permitting the index cards overlying the selected card to pivot downwardly by gravity into a dropped position, thereby displaying the selected index card for access to the information thereon.

The invention will be better understood as well as further objects and advantages thereof become more apparent from the ensueing detailed description of the preferred embodiment taken in conjunction with the drawings.

BRIEF DESCRIPTION OF THE DRAWINGS

FIG. 1 is a perspective view of a telephone index constructed in accordance with the invention;

FIG. 2 is a sectional view taken substantially along line 2—2 of FIG. 1 in the direction of the arrows;

FIG. 3 is a rear elevation view of the telephone index of FIG. 1;

FIG. 4 is a sectional view taken substantially along line 4—4 of FIG. 3 in the direction of the arrows;

FIG. 5 is a sectional view taken substantially along line 5—5 of FIG. 2 in the direction of the arrows;

FIG. 6 is a sectional view taken substantially along line 6—6 of FIG. 2 in the direction of the arrows;

FIG. 7 is a side elevation view of the door utilized in the telephone index of FIG. 1;

FIG. 8 is a side view of a hub member utilized in the telephone index of FIG. 1;

FIG. 9 is a sectional view taken substantially along 9—9 of FIG. 3 in the direction of the arrows; and FIG. 10 is a fragmentary view of a portion of an index card utilized with the telephone index of FIG. 1.

DESCRIPTION OF THE PREFERRED EMBODIMENT

Referring now to FIG. 1, there is shown a telephone index constructed in accordance with the invention and designated generally by the letter I. The telephone index I includes a housing 10 preferably molded in a one piece construction from plastic or the like and is provided with a bottom surface 10*a*, a top wall 11, a pair of side walls 12, 13 and a rear wall 14 which defines an interior 16. The housing 10 is open to provide a front opening 17 for access to the interior 16. Means are provided on the housing rear wall 14 for mounting the housing 10 in a vertically extending position on the surface of an associated wall structure. More specifically, the housing mounting means includes a pair of spaced key hole slots 18, 19 which are arranged on the same horizontal plane to accommodate screws or the like in the well known manner so that the housing may be mounted on the wall's surface in a flush relationship therewith.

The index I includes a closure such as a door 21 also preferably molded in a one piece construction of plastic and means are provided for mounting the door on the housing 10 for pivotal movement between a closed position in the housing front opening 17, which closed position is identified generally in FIG. 2 by the letter C, and a dropped or open position identified generally by the letter O in FIG. 2 in the direction of the arrow P. As will be explained hereinafter, a stack of index cards 22 having identifying tabs 23 along the upper edge thereof and containing information such as addresses, phone numbers and the like, are disposed within the housing interior 16 and are retained within the housing by the door 21 in the closed position C.

In the illustrated embodiment, the door 21 is provided with a pair of flexible side flanges 26, 27 perpendicular with and adjacent the lower edge thereof and molded integrally therewith and outwardly projecting pivot pins are formed on each of the side flanges 26, 27 perpendicular therewith which are receivable within corresponding recesses 31, 32 in the housing sidewalls 12, 13, respectively, as shown best in FIG. 4. As a result of the flexibility of the side flanges 26, 27 and/or the flexibility of the housing sidewalls 12, 13, the door 21 may be easily assembled and disassembled from the housing 10 by withdrawal of the pins 28, 29 from the corresponding recesses 31, 32, respectively.

Means are provided for retaining the door 21 in the closed position C and for easily releasing the door to an open position. More specifically, as shown best in FIGS. 6, 7, the side flanges 26, 27 are provided with detents 33 which are arranged to be accommodated within recesses 34 in the closed position C of the door 21. Thus, as a result of the above referred to flexibility of the side flanges 26, 27 or the housing side walls 12, 13, movement of the door 21 in the direction of the arrow P from the closed position C withdraws the detents 33 from the corresponding recesses 34 permitting the door 21 to be moved into the dropped or open position O of FIG. 2.

The telephone index I includes a slidable, index card selector 36 which is mounted on the housing 10 adjacent to the housing top wall 11 for transverse sliding movement in the direction of the double arrow S of FIG. 1 into a selected transverse position for retaining engagement with a tab 23 on a selected one of the index cards 22 to be displayed. More specifically, a flange member 37 which extends downwardly from the housing top wall 11 between side walls 12 and 13 as shown best in FIGS. 1, 2, is preferably formed integrally therewith and a pair of rearwardly extending, vertically spaced parallel rails 38, 39 are provided on the rear surface of the flange member 37 as shown best in FIG. 2. The flange member 37 is provided with an open or unattached end **37*a* adjacent the housing side wall 12 which permits the slide selector 36 to be detachably mounted on flange member 37**.

The slide member 36 includes a finger grip 41, a tab portion 42 and a support flange 43 all preferably formed integrally of molded plastic in a one piece construction. The support flange 43 is suitably shaped so as to be slidably accommodated between the guide rails 38, 39 of the flange member 37 as shown best in FIG. 2 for sliding movement of the slide index card selector 36 into the selected transverse position for retaining engagement between the tab portion 42 and the tab 23 on the selected one of the index cards 22. Preferably, a release spring 44 is mounted on the support flange 43 as shown best in FIG. 5, and indexing means such as a plurality of equally spaced grooves or slots 46 provided on the rear surface of the flange member 37 which receive a ridge **44*a* on the spring 44 in the selected transverse position of the slide selector 36**.

Means are provided for positioning the stack of index cards 22 in the housing interior 17 for pivotal movement downwardly by gravity from the stored position of FIGS. 1, 2 and a dropped position corresponding to the open position O of the door 21 as shown in FIG. 2. More specifically, each of the cards 22 is provided with a pair of spaced notches 48 in the lower edge portion **22*a* of the cards and each of the notches 48 on an index card is arranged to accommodate the edge portion 51*a* of a hub member 51 as shown best in FIGS. 2 and 8. Thus, two of such hub members 51 are provided, each of which includes a pair of oppositely disposed grooves 52, 53 and a flange 54 extending around the marginal edge of the hub member 51 between the groove portions 52, 53 and the edge portion 51*a* as shown best in FIGS. 4 and 8. The hub members 51 are arranged to be detachably mounted on the housing 10 to support the stack of index cards 22 in the stored position for pivotal movement as explained above. More specifically, the housing rear wall 14 is provided with a pair of transversely spaced slots 56, 57, each of which includes a lower portion of reduced width defined by side edges 56*a*, 56*b* and 57*a*, 57*b*, respectively, adjacent the lower edge 10*a* of the housing 10. The edges 56*a*, 56*b* and 57*a*, 57*b* are arranged to be slidably accommodated within the grooves 52, 53, respectively, in each of the hub members 51, the insertion of the hub members 51 therein being accomplished by positioning the hub members 51 in the upper wider portion of the slots 56, 57 and moving the hub members 51 downwardly into such sliding engagement in abutting engagement with the lower edge portion 10*a* of the housing 10 as shown best in FIG. 3. Means are provided for retaining the hub members 51 in the mounted position of FIGS. 3, 4 which in the illustrated embodiment include spring fingers 58, 59 extending in a parallel manner within the slots 56, 57, respectively, and in the plane of the housing rear wall 14. To mount the hub members 51 in the assembled position of FIG. 3, the spring fingers 58, 59 are moved outwardly as shown in broken lines in FIG. 9, due to the flexible plastic material of the spring fingers 58, 59 and when the hub members 51 are mounted in the housing rear wall 14, the spring fingers 58, 59 are permitted to move back into the solid line unstressed condition for retaining engagement between the free ends 56*c*, 57*c* of the spring fingers 58, 59 respectively, with each of the hub members 51**.

In the operation of the invention, the telephone index is arranged on the supporting wall surface with the parts in the position shown in FIG. 1. When a particular address or telephone number is to be obtained, the slidable index card selector switch 36 is moved to a selected transverse position for engagement of tab portion 42 with the tab 23 on the selected index card 22. The operator then manually engages the upper edge of the door 21 pivoting the door downwardly from the closed position C to the open position O. At this time, as a result of the angular disposition of the index cards 22, the portion of the stack of cards overlying the selected index card as determined by the tab portion 42, falls in the direction of the arrow P by gravity, displaying the information on the selected card. Subsequently, the door 21 may be moved back to the closed position C so that all of the parts again occupy the position of FIG. 1.

Preferably, the housing 10 is provided with a cover element 61 of U-shaped configuration and also of molded plastic material which is detachably mounted on the housing 10 in overlying relationship with the housing top and side walls 11–13.

What is claimed and desired to be secured by Letters Patent of the United States is:

1. A wall mounted telephone index comprising, in combination, a housing having a rear wall, a top wall, a pair of side walls defining an interior, and a front opening, means on said housing rear wall for mounting said housing in a vertically extending position on the surface of an associated wall structure, index card mounting means on said housing for positioning an associated stack of index cards, each of said index cards having an upper edge provided with an index tab and a lower edge provided with spaced slots for mounting said stack of index cards in said housing interior in an upstanding position for pivotal movement downwardly by gravity from a stored position in said housing interior to a dropped position supported by said door, a flange integral with said top wall extending downwardly between said pair of side walls to the front of said rear wall, a slidable index card selector mounted on said flange integral with said housing top wall for sliding movement relative to said flange into a a selected position for retaining engagement with a tab on a selected one of said index cards to be displayed, a door for enclosing said housing front opening, means for pivotally mounting said door on said housing for pivotal movement between a closed position in closing relationship with said front opening to retain said stack of index cards in said upstanding position and a dropped position to open said front opening of said housing thereby permitting the index cards in said stack overlying said selected one of said index cards to fall by gravity into said dropped position.

2. A telephone index in accordance with claim 1 wherein said means for mounting said housing on said wall structure includes a pair of spaced horizontal keyhole slots formed in said housing rear wall.

3. A telephone index in accordance with claim 1 wherein said housing, said door and said slide selector are formed of plastic.

4. A telephone index in accordance with claim 1, wherein said means for pivotally mounting said door on said housing comprises a flange on each side edge of said door perpendicular thereto, an outwardly projecting pivot pin on each of said flanges perpendicular thereto and a first recess in each of said housing side walls for accommodating a corresponding one of said pivot pins.

5. A telephone index in accordance with claim 4 wherein said means for releasably retaining said door in said closed position comprises a detent on each of said door flanges and a second recess in each of said housing side walls for accommodating a corresponding one of said detents in the closed position of said door, said side walls being arranged to flex outwardly to permit release of said detents from said second recesses during the pivotal movement of said door from said closed position to said dropped position.

6. A telephone index in accordance with claim 1, including guide means on said flange member for guiding said slidable index card selector into said selected position and wherein said flange member is provided with an unattached end adjacent one of said housing side walls for assembly and disassembly of said slidable index card selector on said flange member.

7. A telephone index in accordance with claim 6, wherein the rear surface of said flange member is provided with equally spaced slots for indexing said slidable index card selector in each of said selected positions.

8. A telephone index in accordance with claim 1 wherein said housing rear wall includes a bottom edge portion and wherein said means for positioning a stack of index cards in said housing interior comprises a pair of spaced slots in said housing rear wall, said slots having a lower portion terminating adjacent said rear wall bottom edge portion, a pair of hub members, means on said hub members for detachably mounting each of said hub members in a responsive one of the lower portions of said slots, means on each of said hub members for the detachable engagement with said mounting means on said lower edge portions of said index cards to support said stack of index cards in said housing interior for said pivotal movement.

9. A telephone index in accordance with claim 8 wherein said mounting means on each of said hub members comprises a pair of oppositely disposed grooves on said hub member, said pair of grooves being arranged to slidably accommodate the opposed side edges of said slot lower portion with said hub member in abutting engagement with said rear wall bottom edge portion.

10. A telephone index in accordance with claim 9 including a spring finger in each of said slots having an upper end formed integrally with said housing rear wall, said spring fingers arranged to flex out of the plane of said housing rear wall to permit said hub members to be slidably accommodated in the lower portion of said slots in said mounted position, said spring fingers having a free end for engagement with said hub members in the unflexed condition to detachably retain said hub members in said mounted position.

* * * * *